US012601099B2

(12) United States Patent
Damtew et al.

(10) Patent No.: US 12,601,099 B2
(45) Date of Patent: Apr. 14, 2026

(54) DISPENSER ASSEMBLY FOR A LAUNDRY TREATMENT APPLIANCE

(71) Applicant: Haier US Appliance Solutions, Inc., Wilmington, DE (US)

(72) Inventors: FikreAdam Damtew, Louisville, KY (US); Ravisai Vulisi, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 159 days.

(21) Appl. No.: 18/539,747

(22) Filed: Dec. 14, 2023

(65) Prior Publication Data

US 2025/0198074 A1 Jun. 19, 2025

(51) Int. Cl.
*D06F 39/02* (2006.01)
*D06F 33/37* (2020.01)
(Continued)

(52) U.S. Cl.
CPC ..... *D06F 39/022* (2013.01); *D06F 33/37* (2020.02); *D06F 34/14* (2020.02); *D06F 39/02* (2013.01);
(Continued)

(58) Field of Classification Search
CPC ..... D06F 39/02; D06F 39/022; D06F 33/37; D06F 34/14; D06F 2103/00; D06F 2103/60
See application file for complete search history.

(56) References Cited

U.S. PATENT DOCUMENTS 8,122,743 B2 2/2012 Schulze
8,397,544 B2 * 3/2013 Hendrickson ..... A47L 15/4418 68/17 R
(Continued)

FOREIGN PATENT DOCUMENTS

TR 201714950 A2 * 4/2019 ..... D06F 39/022
WO WO2021036409 A1 3/2021
WO WO2022227222 A1 11/2022

OTHER PUBLICATIONS

Machine translation of WO 2022/227222 A1 to Park et al. (Year: 2022).*
(Continued)

*Primary Examiner* — Joseph L. Perrin
(74) *Attorney, Agent, or Firm* — Dority & Manning, P.A.

(57) ABSTRACT

A laundry treatment appliance includes a cabinet forming a receiving space therein; a tub provided within the receiving space; and a dispenser assembly provided within the receiving space, the dispenser assembly being in fluid communication with the tub. The dispenser assembly includes a drawer body insertable to and retractable from the cabinet and provided adjacent to the tub, the drawer body defining at least one receiving compartment; a removable cartridge selectively positioned within the at least one receiving compartment between an inserted position and a removed position; a dosing compartment provided in the drawer body, wherein the dosing compartment is in fluid communication with the removable cartridge when the removable cartridge is in the inserted position; and a sensor in operable communication with the dosing compartment, the sensor configured to sense a level of fluid within the dosing compartment.

20 Claims, 5 Drawing Sheets

(51) Int. Cl.
*D06F 34/14* (2020.01)
*D06F 103/00* (2020.01)
*D06F 103/60* (2020.01)

(52) U.S. Cl.
CPC ..... *D06F 2103/00* (2020.02); *D06F 2103/60* (2020.02)

(56) References Cited

U.S. PATENT DOCUMENTS

| | | | | |
|---|---|---|---|---|
| 8,789,226 | B2 | 7/2014 | Dalton et al. | |
| 10,066,331 | B2 | 9/2018 | Hendrickson et al. | |
| 2010/0300157 | A1* | 12/2010 | Schulze | D06F 39/02 68/17 R |
| 2017/0027410 | A1* | 2/2017 | Stoyanov | A47L 15/0055 |
| 2019/0264364 | A1* | 8/2019 | Chatfield | D06F 39/02 |
| 2020/0277725 | A1* | 9/2020 | Caputo | B65G 43/00 |
| 2021/0062391 | A1* | 3/2021 | Jung | D06F 39/02 |

OTHER PUBLICATIONS

Machine translation of TR 201714950 A2 to Germiyanlioglu et al. (Year: 2019).*

* cited by examiner

DISPENSER ASSEMBLY FOR A LAUNDRY TREATMENT APPLIANCE

FIELD OF THE INVENTION

The present subject matter relates generally to laundry treatment appliances, and more particularly to detergent dispenser assemblies for laundry detergent assemblies.

BACKGROUND OF THE INVENTION

Laundry treatment appliances such as combination washing machine and dryer appliances (washer/dryer) generally include a cabinet which receives a tub for containing wash and rinse water to perform a washing operation, or through which air is circulated to perform a drying operation. A wash basket may be rotatably mounted within the wash tub. A drive assembly may be coupled to the wash tub and configured to rotate the wash basket within the wash tub in order to cleanse articles within the wash basket. Upon completion of a wash cycle, a pump assembly can be used to rinse and drain soiled water to a draining system. In some cases, a drying operation may then be performed.

Prior to each wash cycle, cleaning agents such as detergent are added to the wash chamber. Some laundry treatment appliances include large tanks which may be prefilled with cleaning agents such that at the start of each wash cycle, a user need not manually add the cleaning agents. However, some wash operations may require additional cleaning agents (e.g., bleach, sanitizing agents, other additives, etc.) which must be manually added to the wash chamber. Thus, the convenience of the large, prefilled tank is negated by the necessity to manually add the additional cleaning agents. Additionally or alternatively, users routinely perform cleaning operations on detergent tanks to prevent residue build up, for example. Existing methods for monitoring levels or amounts of additive within the tanks have several drawbacks. For one example, with disposable tanks, including sensors in each tank can be overly expensive. For another example, existing sensors within appliances have difficulties determining liquid levels within enclosed tanks.

Accordingly, a laundry treatment appliance that obviates one or more of the above-mentioned drawbacks would be desirable. In particular, a detergent dispenser assembly including removable and interchangeable tanks with dedicated dosing areas would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet forming a receiving space therein; a tub provided within the receiving space; and a dispenser assembly provided within the receiving space, the dispenser assembly being in fluid communication with the tub. The dispenser assembly may include a drawer body insertable to and retractable from the cabinet and provided adjacent to the tub, the drawer body defining at least one receiving compartment; a removable cartridge selectively positioned within the at least one receiving compartment between an inserted position and a removed position; a dosing compartment provided in the drawer body, wherein the dosing compartment is in fluid communication with the removable cartridge when the removable cartridge is in the inserted position; and a sensor in operable communication with the dosing compartment, the sensor configured to sense a level of fluid within the dosing compartment.

In another exemplary aspect of the present disclosure, a dispenser assembly for a laundry treatment appliance is provided. The laundry treatment appliance may include a cabinet and a tub provided within the cabinet. The dispenser assembly may include a drawer body insertable to and retractable from the cabinet and provided adjacent to the tub, the drawer body defining at least one receiving compartment; a removable cartridge selectively positioned within the at least one receiving compartment between an inserted position and a removed position; a dosing compartment provided in the drawer body, wherein the dosing compartment is in fluid communication with the removable cartridge when the removable cartridge is in the inserted position; and a sensor in operable communication with the dosing compartment, the sensor configured to sense a level of fluid within the dosing compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
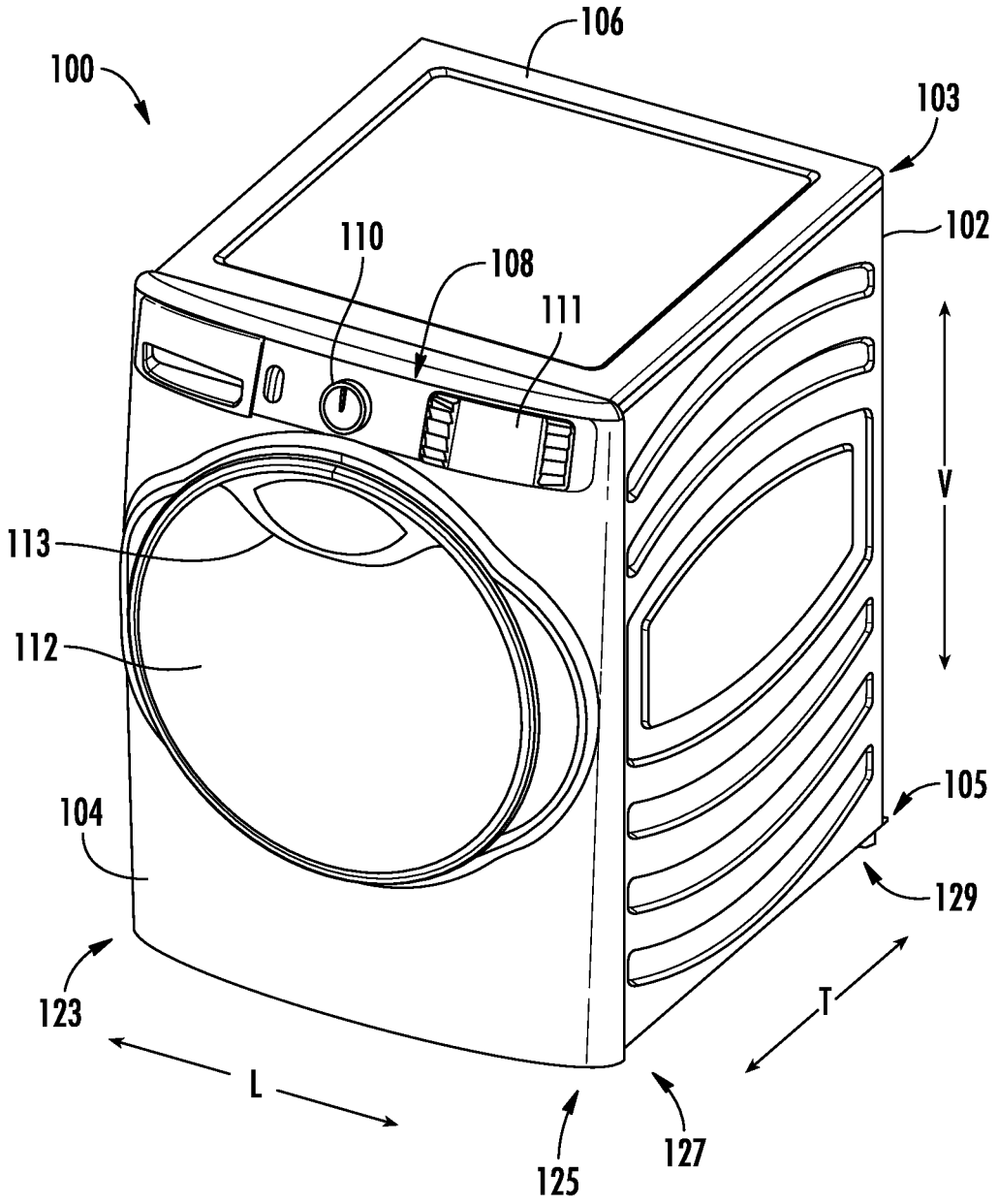
FIG. 1 provides a front perspective view of a laundry treatment appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
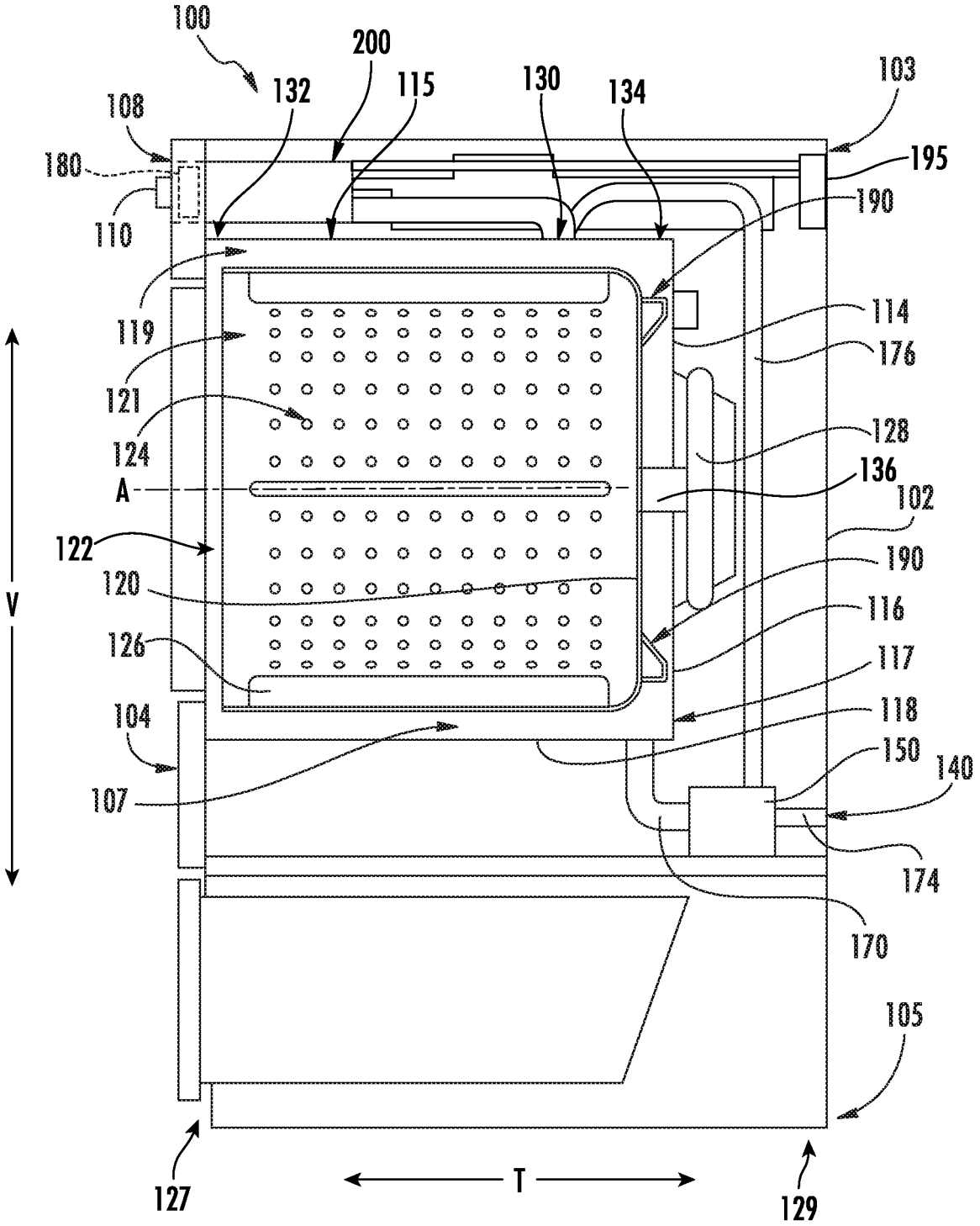
FIG. 2 provides a side schematic view of the exemplary laundry treatment appliance of FIG. 1.

FIGS. 1 and 2 provide various views of an exemplary horizontal axis laundry treatment appliance 100 according to one exemplary embodiment of the present disclosure. For instance, laundry treatment appliance 100 may perform each of a wash cycle or operation and a drying cycle or operation. In particular, FIG. 1 provides a front, perspective view of horizontal axis laundry treatment appliance 100 and FIG. 2 provides a side, section view of laundry treatment appliance 100. As shown in FIG. 1, laundry treatment appliance 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical, lateral, and transverse directions V, L, T defined by laundry treatment appliance 100 are mutually perpendicular and together define an orthogonal direction system.

Cabinet 102 includes a front panel 104. A door 112 is mounted to front panel 104 and is rotatable between an open position (not shown) facilitating access to a wash drum or basket 120 (FIG. 2) located within cabinet 102, and a closed position (shown in FIGS. 1 and 2) hindering access to basket 120. A user may pull on a handle 113 in order to selectively adjust door 112 between the open and closed positions. Cabinet 102 also includes a top panel 106 positioned at top 103 of cabinet 102.

A control panel 108 including a plurality of input selectors 110 is coupled to front panel 104. Control panel 108 and input selectors 110 collectively form a user interface input for operator selection of machine cycles and features. For example, in some embodiments, control panel 108 includes a display 111 (FIG. 1) configured to present or indicate selected features, a countdown timer, and/or other items of interest to machine users.

As shown in FIG. 2, a tub 114 defines a wash fluid compartment 119 configured for receipt of a washing fluid. Thus, tub 114 is configured for containing washing fluid, e.g., during operation of laundry treatment appliance 100 (e.g., a wash cycle or operation). Washing fluid disposed within tub 114 may include, for example, at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of appliance 100. For example, during operation of appliance 100 (e.g., the wash cycle), washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of laundry treatment appliance 100 as described below. In particular, a shaft 136 mechanically couples motor 128 with basket 120 and drivingly rotates basket 120 about a shaft or central axis A, e.g., during a spin cycle. Ribs 126 extend from basket 120 into wash chamber 121. Ribs 126 assist agitation of articles disposed within wash chamber 121 during operation of laundry treatment appliance 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in laundry treatment appliance 100 and can be placed according to any known or desirable configuration. For example, two balancing rings may be respectively placed at the front and back of basket 120.

As further shown in FIG. 2, laundry treatment appliance 100 includes a dispenser assembly 200. Dispenser assembly 200 includes features for receiving various wash treatment additives (e.g., fluid detergent, powder detergent, fabric softener, bleach, powder or any other suitable liquid) and dispensing or directing them to wash fluid compartment 119 of tub 114 during operation of laundry treatment appliance 100. Dispenser assembly 200 will be described in further detail below. In detail, one or more of the additives may be added during either or both of a wash cycle and a drying cycle.

Operation of laundry treatment appliance 100 may be controlled by a processing device or controller 180 that is operatively coupled to control panel 108 for user manipulation to select washing and/or drying cycles and features. In response to user manipulation of control panel 108, controller 180 may operate the various components of laundry treatment appliance 100 to execute selected machine cycles and features.

Controller 180 may include a memory and microprocessor, such as a general or special purpose microprocessor operable to execute programming instructions or microcontrol code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of laundry treatment appliance 100 may be in communication with controller 180 via one or more signal lines or shared communication busses.

In an illustrative example of operation of laundry treatment appliance 100, laundry items are loaded into basket 120, and washing operation is initiated through operator manipulation of input selectors 110. Tub 114 is filled with water and one or more wash treatment additives from dispenser assembly 200 to form a wash fluid. One or more valves of a water inlet valve 195 can be actuated by controller 180 to provide for filling tub 114 to the appropriate level for the amount of articles being washed. Water inlet valve 195 is in fluid communication with a water source, such as e.g., a hot water heater and/or a municipal water line. Once tub 114 is properly filled with wash fluid, the contents of basket 120 are agitated with ribs 126 for cleansing of laundry items in basket 120.

After the agitation phase of the wash cycle is completed, tub 114 is drained. Laundry articles can then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

Upon completion of the wash cycle, laundry treatment appliance 100 may perform a drying cycle. For instance, after the spin cycle is completed and excess wash fluid and/or water has been drained from the tub, laundry treatment appliance may begin the drying cycle (e.g., circulating air through tub 114 and/or wash chamber 121). The drying cycle may be performed automatically upon completion of the wash cycle, or may be initiated separately by the user upon the completion of the wash cycle. In at least one embodiment, the drying cycle commences automatically within a predetermined amount of time after the completion of the wash cycle (e.g., by utilizing additives provided in one of the chambers of dispenser assembly 200, described below).

While described in the context of a specific embodiment of horizontal axis laundry treatment appliance 100, it will be understood that horizontal axis laundry treatment appliance 100 is provided by way of example only. Other laundry treatment appliances having different configurations, different appearances, and/or different features may also be utilized with the present subject matter as well, including, for example, vertical axis laundry treatment appliances. Thus, the teachings of the present disclosure are not limited to use with laundry treatment appliance 100.

Turning now to FIGS. 3 through 7, a dispenser assembly 200 according to one or more embodiments of the present disclosure will be described in detail. According to the present disclosure, the described dispenser assembly may be incorporated into a variety of laundry treatment apparatuses. For instance, dispenser assembly 200 may be installed within a combination washing machine and dryer. Advantageously, the features of the described dispenser assembly may allow for a seamless performance of both a washing operation and a drying operation. However, additional uses will be apparent to one having ordinary skill in the art.

Dispenser assembly 200 may include a dispenser drawer. For instance, as will be described below, the dispenser drawer of dispenser assembly 200 may be insertable into laundry treatment appliance 100. As shown in FIGS. 1 and 2, dispenser assembly 200 may be positioned at a front face of laundry treatment appliance 100. However, it should be understood that dispenser assembly 200 is shown by way of example only, and additional or alternative embodiments may include bottom dispensers, top dispensers, dispensers positioned within a wash fluid compartment (e.g., in a top load or vertical axis laundry machine), or the like.

Figure 7:
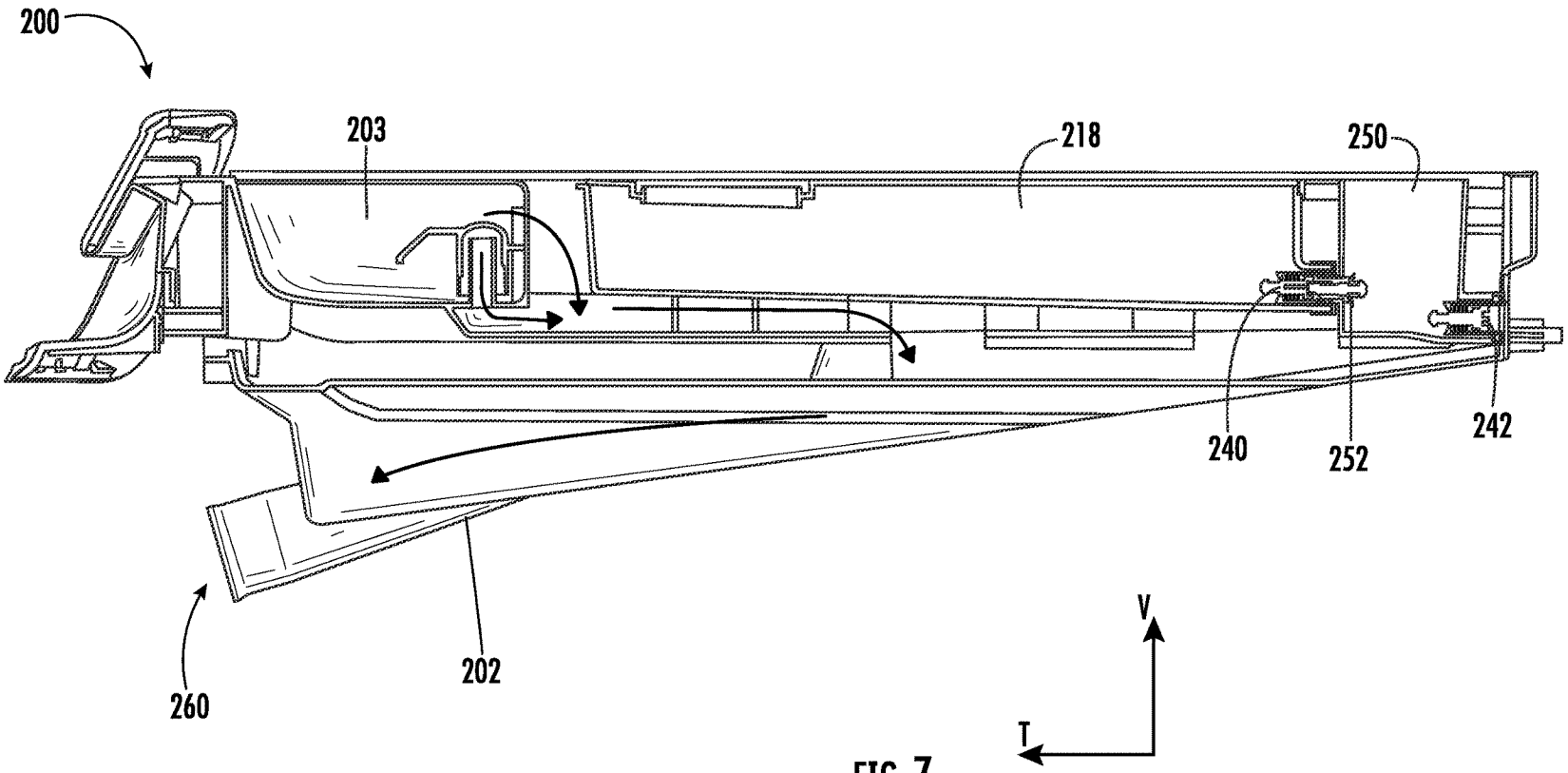
FIG. 7 provides a side section view of the exemplary dispenser assembly of FIG. 3.

Dispenser assembly 200 may include a dispenser body 202 (FIG. 7). Dispenser body 202 may be a housing or frame member configured to be installed within cabinet 102 of laundry treatment appliance 100. For instance, dispenser body 202 may be installed at or near top 103 of cabinet 102, adjacent to opening 122. Additionally or alternatively, dispenser assembly 200 may be provided at or near a side of cabinet 102 (e.g., first side 123, second side 125). Dispenser body 202 may be in fluid communication with wash tub 114. For instance, a tube or pipe may connect dispenser body 202 to wash tub 114. Water and/or one or more fluid additives may flow from dispenser body 202 through a tub supply conduit into wash tub 114 to perform a laundry operation. As will be explained in more detail below, a single outlet 260 may be formed in dispenser body 202 through which contents of two separate drawer cups (and/or tanks) may flow into wash tub 114.

Dispenser assembly 200 may include a drawer body 204. For instance, as mentioned above, drawer body 204 may be insertable and retractable with respect to front panel 104 of cabinet 102 (e.g., into dispenser body 202). Drawer body 204 may be elongated along the transverse direction T. Accordingly, drawer body 204 may be withdrawn and inserted along the transverse direction T (e.g., into dispenser body 202).

Figure 3:
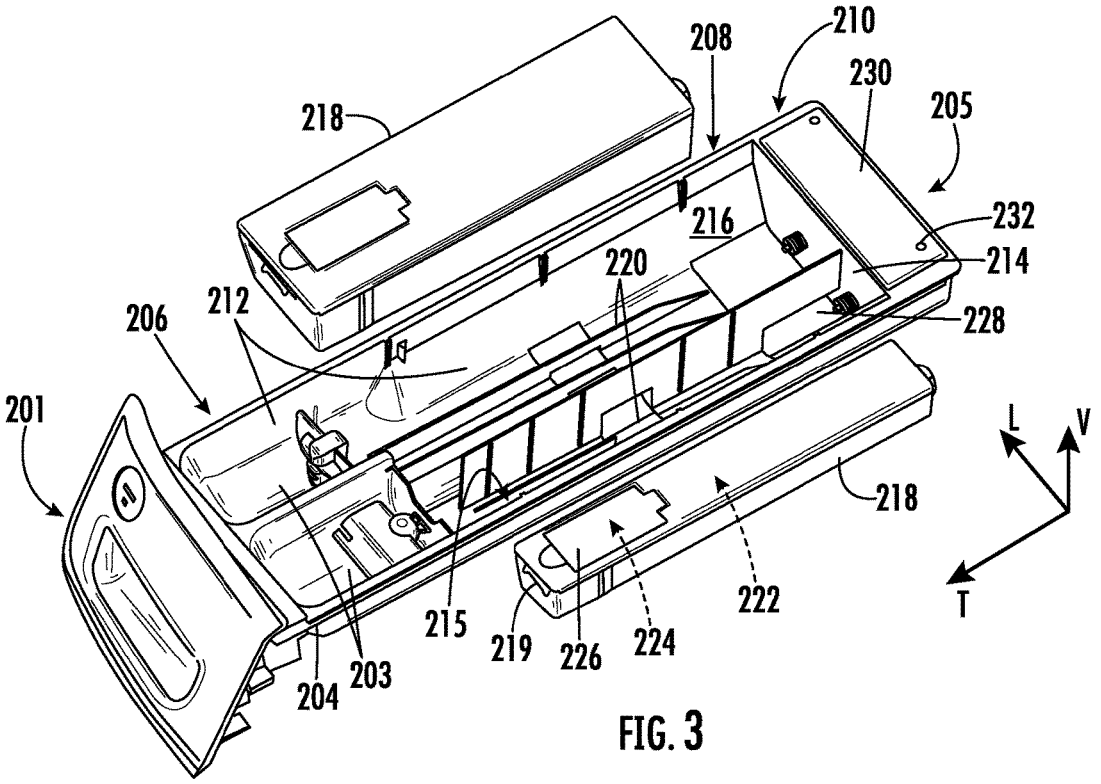
FIG. 3 provides a perspective view of a dispenser assembly according to exemplary embodiments of the present disclosure, with removable tanks in a removed position.

Drawer body 204 may be divided into a plurality of regions. For instance, drawer body 204 may define a front region 206, a middle or central region 208, and a back or rear region 210. Front region 206, middle region 208, and rear region 210 may be provided sequentially along the transverse direction T from a front 201 to a rear 205 of drawer body 204. For instance, FIG. 3 provides a perspective view of drawer body 204 and a cartridge (described below) according to some embodiments.

Drawer body 204 may define a plurality of receiving compartments or chambers 212. The plurality of receiving compartments 212 may be divided between front region 206, middle region 208, and rear region 210. For instance, front region 206 may include at least two receiving compartments 212 (e.g., manual dosing cups 203) and rear region 210 (or middle region 208) may include at least two receiving compartments 212. However, it should be understood that the number and specific division or allotment of receiving compartments 212 between front region 206, middle region 208, and rear region 210 may vary according to specific embodiments. Additionally or alternatively, the plurality of receiving compartments 212 may be divided into two regions, or four or more regions of drawer body 204.

Figure 4:
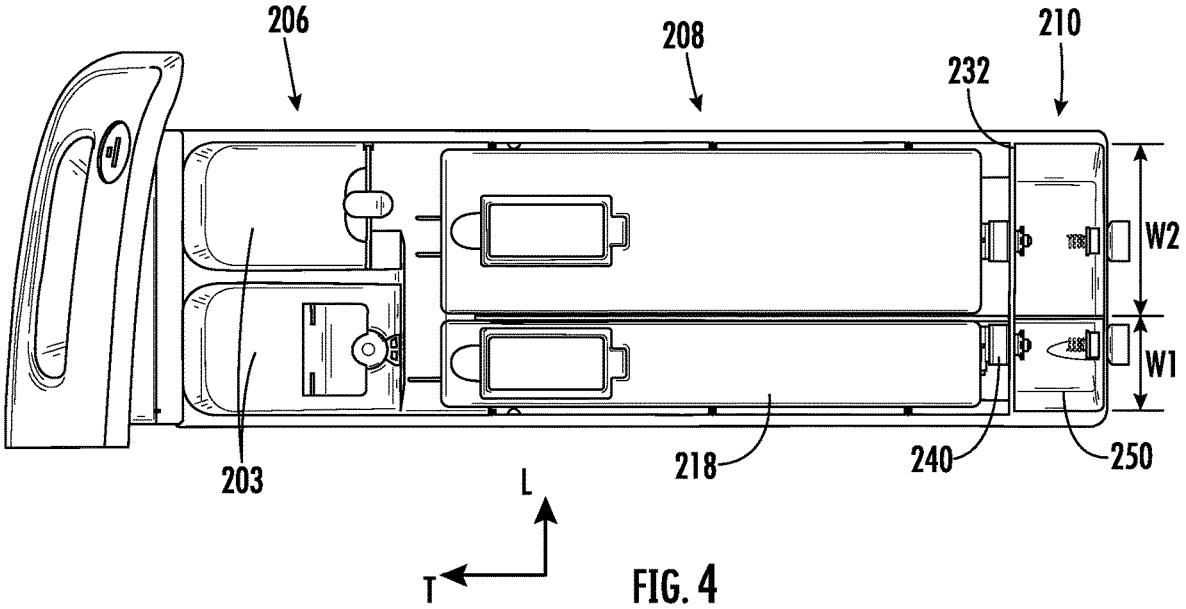
FIG. 4 provides a top view of the exemplary dispenser assembly of FIG. 3 with the removable tanks in an inserted position.
Figure 5:
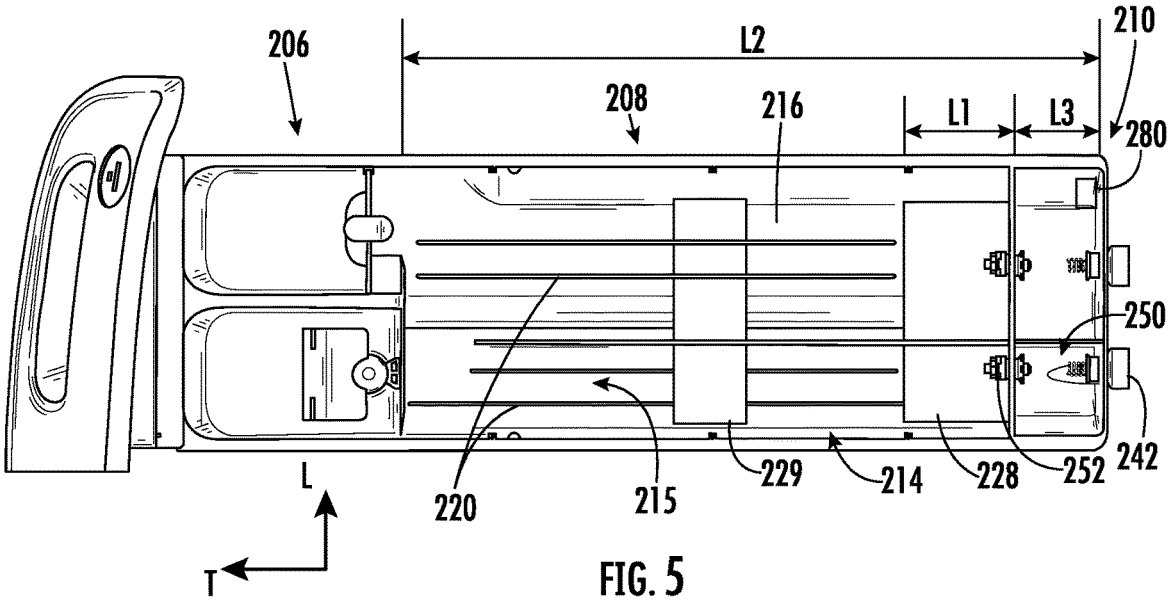
FIG. 5 provides a top view of the exemplary dispenser assembly of FIG. 3 with the removable tank in the removed position.
Figure 6:
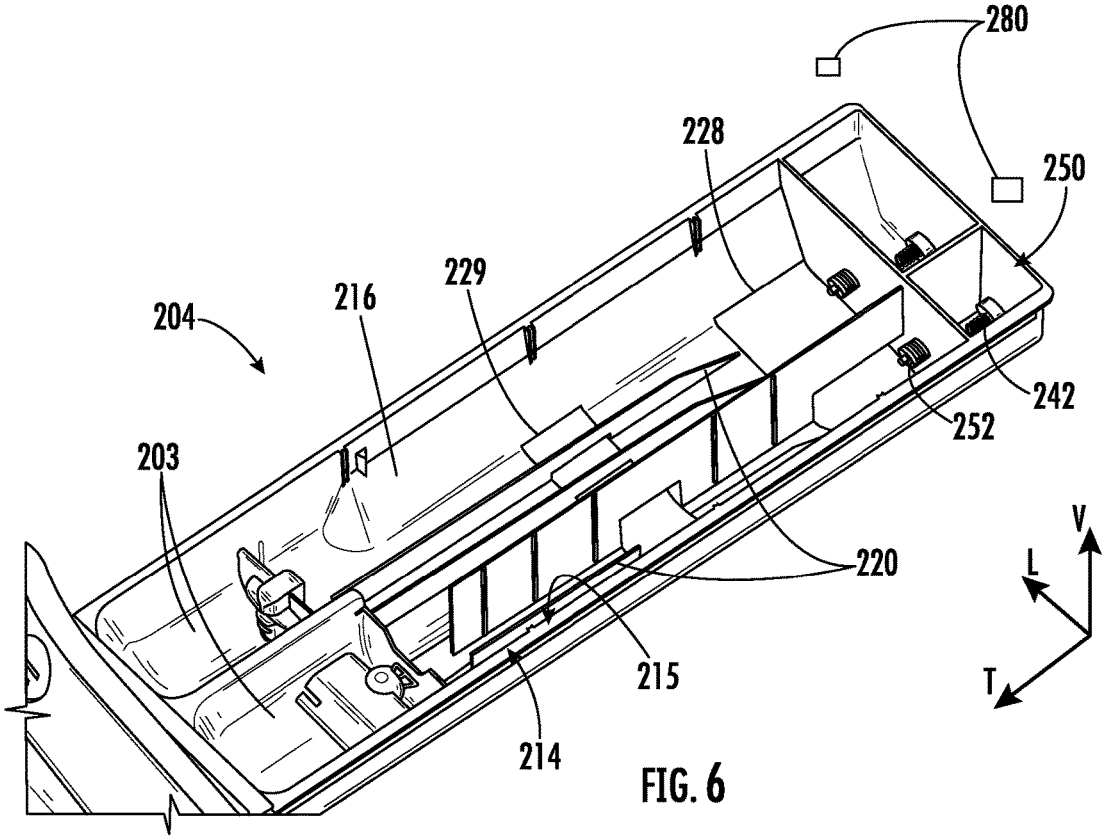
FIG. 6 provides a perspective view of the exemplary dispenser assembly of FIG. 3 with the removable tank in the removed position.

Referring now to FIGS. 4 through 6, an exemplary embodiment of dispenser assembly 200 will be described in detail. According to the illustrated embodiment, middle region 208 may extend for a predetermined length (e.g., along the transverse direction T). The predetermined length may be greater than that of front region 206 and rear region 210. Middle region 208 may include a first receiving compartment 214 and a second receiving compartment 216. First receiving compartment 214 and second receiving compartment 216 may be positioned adjacent to each other along the lateral direction L. For instance, each of first receiving compartment 214 and second receiving compartment 216 may extend along the transverse direction T for an entire length of middle region 208.

First receiving compartment 214 may be configured to receive a removable cartridge 218 therein. In detail, first receiving compartment 214 may form a receiving space into which removable cartridge 218 can be positioned. Thus, removable cartridge 218 may be positioned within first receiving compartment 214 between an inserted position (FIG. 4) and a removed position (FIG. 3).

First receiving compartment 214 may include a plurality of ribs 220. Referring particularly to FIGS. 5 and 6, the plurality of ribs 220 may be formed into a bottom surface 215 of first receiving compartment 214. For instance, the plurality of ribs 220 may extend along the transverse direction T. Any suitable number of ribs 220 may be included, such as 2 ribs, 3 ribs, 4 ribs, or the like. each of the plurality of ribs 220 may protrude along the vertical direction V (e.g., from bottom surface 215 of first receiving compartment 214). Additionally or alternatively, ribs 220 may be formed into a sidewall (e.g., a first lateral sidewall, a second lateral sidewall, etc.) of first receiving compartment 214. Accordingly, when removable cartridge 218 is in the inserted position, the plurality of ribs 220 contact removable cartridge 218 (e.g., an underside of removable cartridge 218). Advantageously, removable cartridge 218 may be correctly guided into the inserted position, assisting in proper location and connection within drawer body 204.

A first aperture 228 may be formed through bottom surface 215 of first receiving compartment 214 (e.g., through a bottom of drawer body 204). For instance, a portion of drawer body 204 may be removed from first receiving compartment 214. In some embodiments, first aperture 228 extends an entire lateral width of drawer body 204 (e.g., through first receiving compartment 214 and second receiving compartment 216). First aperture 228 may be positioned at or near a rear of middle region 208 (e.g., at or near a junction of middle region 208 and rear region 210). Accordingly, first aperture 228 may be positioned below a rear portion of removable cartridge 218. At least a portion of first aperture 228 may be formed along the lateral direction L. Thus, removable cartridge 218 may be exposed through first aperture 228 when in the inserted position.

First aperture 228 may define a length L1 along the transverse direction T. For instance, length L1 of aperture 228 may be a predetermined percentage of a total length L2 of middle region 208 (or first receiving compartment 214). According to some embodiments, the predetermined percentage is between about 10% and about 25% of total length L2. Accordingly, removable cartridge 218 may be supported by bottom surface 215 for over half of total length L2 of first receiving compartment 214. Advantageously, a user may press down (e.g., along the vertical direction V) on a rear of removable cartridge 218, which may penetrate through first aperture 228. Consequently, a front portion of removable cartridge 218 may rise up along the vertical direction V, allowing the user to easily grasp and remove removable tank 218 from first receiving compartment 214 (e.g., to the removed position). For instance, removable cartridge 218 may include a grasp tab 219. Grasp tab 219 may protrude from a front surface of removable cartridge 218. Grasp tab 219 may allow for a user to easily lift and remove removable cartridge 218 from first receiving compartment 214. For another example, while drawer body 204 is partially inserted within dispenser body 202, the user may lift the front of removable cartridge 218 (e.g., along the vertical direction V) via grasp tab 219 and pull removable cartridge 218 forward (e.g., along the transverse direction T). The rear of removable cartridge 218 may then pivot partially into first aperture 228 to allow for easy removal therefrom.

According to some embodiments, a second aperture 229 may be formed through bottom surface 215 of first receiving compartment 214 (e.g., through a bottom of drawer body 204). For instance, a second portion of drawer body 204 may be removed from first receiving compartment 214 (and second receiving compartment 216). In some embodiments, second aperture 229 extends an entire lateral width of drawer body 204 (e.g., through first receiving compartment 214 and second receiving compartment 216). Second aperture 229 may be positioned at or near a center of middle region 208. Accordingly, second aperture 229 may be closer to first portion 206 than first aperture 228. Second aperture 229 may be fluidly connected with first portion 206 (e.g., cups 203). Fluid contained within front portion 206 may be selectively delivered to tub 114 via second aperture 229. For instance, fluid may be released from one or more of cups 203 and may flow down bottom surface 215 toward second aperture 229 (e.g., beneath removable cartridge 218).

Removable cartridge 218 may be a tank (e.g., storage tank, additive tank, etc.). For instance, removable cartridge 218 may define an additive receiving space 222 therein. Thus, removable cartridge 218 may be selectively filled with a laundry additive (e.g., detergent, stain remover, softener, bleach, disinfectant, etc.). Removable cartridge 218 may define a filling port 224. Thus, the laundry additive may be supplied to additive receiving space 222 via filling port 224. Additionally or alternatively, removable cartridge 218 may include a cap or top 226. Cap 226 may be movably connected to removable cartridge 218 (e.g., to a top panel thereof). For instance, cap 226 may be rotatably connected to removable cartridge 218. However, the specific connection means of cap 226 to removable cartridge 218 may vary according to specific embodiments, and may be, for example, slidably attached. Additionally or alternatively, removable cartridge 218 may include a cover (e.g., similar to cover 230, described below) coupled thereto. In such an instance, filling port 224 may be defined within the cover. Likewise, cap 226 may be movably coupled to the cover.

Removable cartridge 218 may include a valve 240. Valve 240 may be located at a rear of removable cartridge 218. For instance, valve 240 may penetrate a rear face of removable cartridge 218. Valve 240 may be a plunger type valve configured to connect or mate with a pump (e.g., peristaltic pump). Additionally or alternatively, valve 240 may be configured to connect or mate with a receiving valve (or first valve, described below) to provide fluid communication between removable cartridge 218 and rear portion 210 of drawer body 204. Accordingly, valve 240 may provide selective fluid access to additive receiving space 222. For instance, the pump (or receiving valve) may include a nozzle or the like to engage with valve 240 when removable cartridge 218 is in the inserted position.

Second receiving compartment 216 may be referred to as a bulk tank. Accordingly, second receiving compartment 216 may be configured to hold, store, or otherwise contain a predetermined amount of an additive (e.g., liquid additive), such as laundry detergent, fabric softener, bleach, or the like. As mentioned above, second receiving compartment 216 may be positioned laterally adjacent to first receiving compartment 214. Additionally or alternatively, second receiving compartment 216 may be wider (e.g., along the lateral direction L) than first receiving compartment 214. For instance, a width W1 of first receiving compartment 214 may be less than a width W2 of second receiving compartment 216. Accordingly, a volume of second receiving compartment 216 may be greater than a volume of first receiving compartment 214. However, specific sizes (e.g., lengths, widths, depths, volumes, etc.) of each of first receiving compartment 214 and second receiving compartment 216 may vary according to specific embodiments. Additionally or alternatively, according to some embodiments, second receiving compartment 216 may selectively house an additional removable cartridge (e.g., similar to removable cartridge 218) as shown in FIGS. 3 and 4. It should be understood that the disclosure is not limited to the embodiments provided herein, and that second receiving compartment 216 may vary according to specific embodiments.

Referring now particularly to FIGS. 4 through 6, drawer body 204 may include one or more dosing compartments 250. For instance, as shown in the figures, two dosing compartments 250 may be provided. However, it should be understood that the number of dosing compartments 250 may vary according to specific embodiments. Hereinafter, a single dosing compartment 250 will be described in detail with the understanding that the description is applicable to multiple dosing compartments.

Dosing compartment 250 may be provided at rear region 210 of drawer body 204. Accordingly, dosing compartment 250 may be positioned behind (e.g., along the transverse direction T) first receiving compartment 214 (and removable cartridge 218). A length L3 of dosing compartment 250 may be less than the length L2 of first receiving compartment 214 (e.g., along the transverse direction T). Thus, dosing compartment 250 may be smaller (e.g., in volume) than first receiving compartment 214 (and subsequently removable cartridge 218).

Dosing compartment 250 may receive liquid (e.g., additive) from removable cartridge 218. As mentioned above, drawer body 204 may include a first valve 252 (e.g., a receiving valve). First valve 252 may be configured to selectively mate with valve 240 of removable cartridge 218. For instance, valve 240 may axially contact with first valve 252 such that each valve is opened (e.g., to allow fluid communication therebetween).

First valve 252 may be a check valve. In detail, first valve 252 may define a closed position and an open position. When removable cartridge 218 is in the removed position, first valve 252 may be normally closed (e.g., in the closed position). Accordingly, fluid may be restricted from leaking from dosing compartment 250 when removable cartridge 218 is removed from the inserted position. Thus, at least one of valve 240 or first valve 252 may include a spring-loaded plunger. As removable cartridge 218 is inserted to the inserted position, the spring-loaded plunger (or plungers) may be axially compressed to allow the fluid to flow from removable cartridge 218 into dosing compartment 250. The fluid may flow freely such that an equilibrium is reached between removable cartridge 218 and dosing compartment 250 when removable cartridge 218 is in the inserted position.

Drawer body 204 may include a cover 230. Cover 230 may be removably coupled to drawer body 204, e.g., between an attached position (FIG. 3) and a detached position (FIG. 4). For instance, cover 230 may be removably positioned over one or more dosing compartments 250. Cover 230 may be attached to drawer body 204 by any suitable means, such as a plurality of snap hooks, an adhesive, a magnet, one or more latches, or the like. Thus, cover 230 may be provided over top of dosing compartment 250 along the vertical direction V.

Cover 230 may include or may define a vent opening 232. Thus, dosing compartment 250 may be air vented via vent opening 232. For instance, air within dosing compartment 250 may be allowed to flow out therefrom via vent opening 232. Likewise, air from outside of dosing compartment 250 may easily flow thereinto via vent opening 232. Additionally or alternatively, vent opening 232 may allow an optical communication therethrough. For instance, dispenser assembly 200 may include a sensor 280 (FIG. 6) configured to monitor one or more attributes of dosing compartment 250. Sensor 280 may be positioned outside of dosing compartment 250 (e.g., above dosing compartment 250 along the vertical direction V). Thus, sensor 280 may be in operable communication with dosing compartment 250 through vent opening 232. However, according to some embodiments, sensor 280 is in operable communication with dosing compartment 250 via a separate, dedicated opening (e.g., a window, a through-hole, etc.) apart from vent opening 232.

Drawer body 204 may include a second valve (or outlet valve) 242. Second valve 242 may be provided at dosing compartment 250, opposite first valve 252 (e.g., along the transverse direction T). In particular, second valve 242 may be located at a rear of dosing compartment 250 along the transverse direction T. For instance, second valve 242 may penetrate a rear face of dosing compartment 250. Second valve 242 may be a plunger type valve configured to connect or mate with a pump (e.g., peristaltic pump). Accordingly, second valve 242 may provide selective fluid access to dosing compartment 250. For instance, the pump may include a nozzle or the like to engage with second valve 242 when drawer body 204 is in the inserted position. Accordingly, second valve 242 may selectively release fluid from dosing compartment 250 to tub 114 (e.g., via the pump).

As mentioned above, dispenser assembly 200 may include a sensor 280. Generally, sensor 280 may sense a level of liquid contained within dosing compartment 250. In some embodiments, sensor 280 is in operable communication with controller 180. For instance, sensor 280 may communicate with controller 180 via one or more signals. In certain embodiments, sensor 280 (or controller 180) includes a predetermined threshold level (e.g., to indicate the need for additional liquid to dosing compartment 250). In particular, sensor 280 may detect if or when the liquid within dosing compartment 250 is below the predetermined threshold level. The determined level of liquid may be transmitted to controller 180 whereby it is compared with the stored threshold level. Optionally, sensor 280 may be a two-position sensor. In other words, sensor 280 may either be "on" or "off," depending on a level of liquid. It should be understood that sensor 280 may be any suitable sensor capable of determining a level of liquid within dosing compartment 250, such as an optical sensor, a float sensor, an infrared sensor, or the like, and the disclosure is not limited to those examples provided herein.

Sensor 280 may be positioned within dosing compartment 250 (FIG. 5). For instance, sensor 280 may be a float sensor located within dosing compartment 250 to physically determine the level of liquid (e.g., additive) within dosing compartment 250. Additionally or alternatively, sensor 280 may be positioned outside of drawer body 204 and otherwise in operable communication with dosing compartment 250 (FIG. 6). For another example, sensor 280 is positioned above dosing compartment 250 (e.g., along the vertical direction V). Thus, sensor 280 may be an optical sensor configured to determine the level of liquid within dosing compartment 250 via one or more optical signals. As would be understood, multiple sensors 280 may be included, according to a number of dosing compartments 250 provided within drawer body 204.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a mutually orthogonal vertical direction, a lateral direction, and a transverse direction, the laundry treatment appliance comprising:
- a cabinet forming a receiving space therein;
- a tub provided within the receiving space; and
- a dispenser assembly provided within the receiving space, the dispenser assembly being in fluid communication with the tub, the dispenser assembly comprising:
  - a drawer body insertable to and retractable from the cabinet and provided adjacent to the tub, the drawer body defining a front region and a middle region provided sequentially along the transverse direction, the drawer body defining a first aperture formed through a bottom surface thereof and a second aperture formed through the bottom surface and spaced apart from the first aperture along the transverse direction, the second aperture being in fluid communication with the front region;
  - at least one receiving compartment provided in the middle region;
  - a removable cartridge selectively positioned within the at least one receiving compartment between an inserted position and a removed position;
  - a dosing compartment provided in the drawer body separate from the at least one receiving compartment, wherein the dosing compartment is in fluid communication with the removable cartridge when the removable cartridge is in the inserted position; and
  - a sensor in operable communication with the dosing compartment, the sensor configured to sense a level of fluid within the dosing compartment.

2. The laundry treatment appliance of claim 1, further comprising:
- a first valve positioned between the at least one receiving compartment and the dosing compartment, wherein the first valve operably connects with the removable cartridge when the removable cartridge is in the inserted position.

3. The laundry treatment appliance of claim 2, wherein the first valve is a check valve having a normally closed position when the removable cartridge is in the removed position.

4. The laundry treatment appliance of claim 1, further comprising a second valve provided at the dosing compartment apart from the first valve, the second valve being configured to selectively release fluid from the dosing compartment to the tub.

5. The laundry treatment appliance of claim 1, wherein the removable cartridge is a tank defining an additive receiving space therein.

6. The laundry treatment appliance of claim 1, wherein the dispensing assembly further comprises:

a cover positioned over the dosing compartment; and a vent opening defined through the cover, the vent opening allowing fluid communication between the dosing compartment and an ambient atmosphere.

7. The laundry treatment appliance of claim 6, wherein the sensor is positioned outside of the dosing compartment along the vertical direction, and wherein the sensor in operable communication with the dosing compartment through vent opening.

8. The laundry treatment appliance of claim 1, wherein the second aperture is positioned closer to the front region than the first aperture and is configured to receive fluid from one or more manual cups in the front region.

9. The laundry treatment appliance of claim 1, wherein the first aperture is positioned below a rear portion of the removable cartridge such that pressing downward on the rear portion causes a front portion of the removable cartridge to rise for removal.

10. The laundry treatment appliance of claim 1, wherein the first aperture extends across an entire lateral width of the drawer body.

11. A dispenser assembly for a laundry treatment appliance, the laundry treatment appliance comprising a cabinet and a tub provided within the cabinet, the dispenser assembly defining a vertical direction, a lateral direction, and a transverse direction, the dispenser assembly comprising:

a drawer body insertable to and retractable from the cabinet and provided adjacent to the tub, the drawer body defining a front region and a middle region provided sequentially along the transverse direction, the drawer body defining a first aperture formed through a bottom surface thereof and a second aperture formed through the bottom surface and spaced apart from the first aperture along the transverse direction, the second aperture being in fluid communication with the front region;

at least one receiving compartment provided in the middle region;

a removable cartridge selectively positioned within the at least one receiving compartment between an inserted position and a removed position;

a dosing compartment provided in the drawer body separate from the at least one receiving compartment, wherein the dosing compartment is in fluid communication with the removable cartridge when the removable cartridge is in the inserted position; and a sensor in operable communication with the dosing compartment, the sensor configured to sense a level of fluid within the dosing compartment.

12. The dispenser assembly of claim 11, further comprising:

a first valve positioned between the at least one receiving compartment and the dosing compartment, wherein the first valve operably connects with the removable cartridge when the removable cartridge is in the inserted position.

13. The dispenser assembly of claim 12, wherein the first valve is a check valve having a normally closed position when the removable cartridge is in the removed position.

14. The dispenser assembly of claim 11, further comprising a second valve provided at the dosing compartment apart from the first valve, the second valve being configured to selectively release fluid from the dosing compartment to the tub.

15. The dispenser assembly of claim 11, wherein the removable cartridge is a tank defining an additive receiving space therein.

16. The dispenser assembly of claim 11, further comprising:

a cover positioned over the dosing compartment; and a vent opening defined through the cover, the vent opening allowing fluid communication between the dosing compartment and an ambient atmosphere.

17. The dispenser assembly of claim 16, wherein the sensor is positioned outside of the dosing compartment along the vertical direction, and wherein the sensor in operable communication with the dosing compartment through vent opening.

18. The dispenser assembly of claim 11, wherein the second aperture is positioned closer to the front region than the first aperture and is configured to receive fluid from one or more manual cups in the front region.

19. The dispenser assembly of claim 11, wherein the first aperture is positioned below a rear portion of the removable cartridge such that pressing downward on the rear portion causes a front portion of the removable cartridge to rise for removal.

20. The dispenser assembly of claim 11, wherein the first aperture extends across an entire lateral width of the drawer body.

* * * * *